US006954945B2

(12) United States Patent
Ebihara

(10) Patent No.: US 6,954,945 B2
(45) Date of Patent: Oct. 18, 2005

(54) ARTICLE-DROPPING PROOF POCKET FOR GARMENTS

(76) Inventor: Kenzo Ebihara, 2-4-28, Wato, Miyashiro-machi, Minami-saitama-gun, Saitama (JP), 345-0836

( * ) Notice: Subject to any disclaimer, the term of this patent is extended or adjusted under 35 U.S.C. 154(b) by 50 days.

(21) Appl. No.: 10/657,176

(22) Filed: Sep. 9, 2003

(65) Prior Publication Data

US 2004/0133966 A1 Jul. 15, 2004

Related U.S. Application Data

(63) Continuation-in-part of application No. 10/378,926, filed on Mar. 5, 2003, now abandoned.

(30) Foreign Application Priority Data

Nov. 5, 2002 (JP) ..... 2002-321036

(51) Int. Cl.[7] ..... A41D 27/20
(52) U.S. Cl. ..... 2/250
(58) Field of Search ..... 2/108, 94, 69, 2/79, 102, 247, 253, 250

(56) References Cited

U.S. PATENT DOCUMENTS

| | | | |
|---|---|---|---|
| 5,048,122 | A | 9/1991 | Prieur |
| 5,157,789 | A | 10/1992 | Klass |
| 5,725,039 | A | 3/1998 | Macinai et al. |
| 6,105,170 | A | 8/2000 | Lisciandro et al. |
| 6,314,580 | B1 | 11/2001 | Greenberg et al. |

FOREIGN PATENT DOCUMENTS

| | | |
|---|---|---|
| JP | 2000-136413 | 5/2000 |

*Primary Examiner*—Tejash Patel
(74) *Attorney, Agent, or Firm*—Wenderoth, Lind & Ponack, L.L.P.

(57) ABSTRACT

Disclosed is an article-dropping proof pocket for garments, which pocket is capable of preventing small articles from springing out and failing down from the pocket even if a person wearing the garment bends downwardly or moves quickly. The pocket comprises a piece of seal cloth fixed to a front or rear side of a garment cloth inside of and in the vicinity of an upper edge of a small flat cloth for closing an opening of the upper edge of the small flat cloth, and fastening structure for detachably fastening the piece of seal cloth to the small flat cloth.

20 Claims, 12 Drawing Sheets

ARTICLE-DROPPING PROOF POCKET FOR GARMENTS

This application is a continuation-in-part of U.S. application Ser. No. 10/378,926, filed Mar. 5, 2003.

BACKGROUND OF THE INVENTION

1. Field of the Invention

The present invention relates to a pocket for garments, particularly to a pocket preventing small articles from slipping out from inside the pocket even if a person wearing the garment bends downwardly or moves quickly.

2. Related Art

Such an article-dropping proof pocket is disclosed in Japan Patent 2000-136413(A). A button is fastened to a garment within the pocket by sewing with thread, and a pocket cloth has a buttonhole therein. A small article with a loop string is put in the pocket, and the button passes through the loop string and the buttonhole for fastening, thereby preventing the small article from slipping out from the pocket.

Articles having no loop strings, such as eyeglasses or purses, however, cannot be prevented from slipping out from such an article-dropping proof pocket.

Inconveniently, an article with a loop string cannot be put in an article-dropping condition without passing the button through the loop string and the buttonhole of the pocket, and the article cannot be removed from the pocket without removing the button from the buttonhole and the loop string.

An article with a loop string can be prevented from falling out of the pocket and from being lost, but it may happen that the article springs out of the pocket to hang down outside thereof.

There is a demand for preventing all small articles having no extra means, such as loop strings, from slipping out from a pocket, while allowing them to be kept in and removed from the pocket readily.

SUMMARY OF THE INVENTION

To attain this object a pocket comprising a small flat cloth sewn onto a front side of a garment cloth with its upper edge open is improved according to the present invention in that the pocket further comprises a piece of seal cloth fixed to the garment cloth inside of, and in the vicinity of the upper edge of the small flat cloth, for closing an opening of the upper edge of the small flat cloth, and fastening structure for detachably fastening the piece of seal cloth to the small flat cloth.

A pocket comprising a small flat cloth sewn onto a rear side of a garment cloth with its upper edge open to a front side of the garment cloth is improved according to the present invention in that the pocketfurther comprises a piece of seal cloth fixed to the small flat cloth for closing an opening of the upper edge of the small flat cloth, and fastening structure for detachably fastening the piece of seal cloth to the garment cloth.

With these arrangements small articles can be kept in the pocket, which is so sealed that the articles cannot be allowed to slip out from the pocket even if a person wearing the garment should bend downwardly or move quickly.

The fastening structure may comprise a magnet member attached to one of the small flat cloth (or confronting garment cloth) and the piece of seal cloth, and a piece of metal sheet attached to the other of these cloths. The fastening structure may comprise a hook and loop fastener.

These arrangements facilitate the putting-in and taking-out of small articles from the pocket. Use of a hook and loop fastener causes a person wearing the garment to feel nothing strange since material thereof is as soft as cloth of the pocket.

The piece of seal cloth may have a reinforcement piece attached thereto. The reinforcement piece effectively prevents twisting of the piece of seal cloth to assure that it provides a good sealing function. The reinforcement piece may be of a sheet of thin synthetic resin or metal. The piece of seal cloth may have a bag-like catch extension contiguous thereto. When a person wearing the garment bends downwardly, the article can be caught by the bag-like catch extension of the pocket, thus preventing unsealing of the pocket, which otherwise might be caused if the article should be heavy.

Other objects and advantages of the present invention will be understood from the following description of pockets according to some preferred embodiments of the present invention, which are shown in accompanying drawings.

DETAILED DESCRIPTION OF PREFERRED EMBODIMENTS

Figure 1:
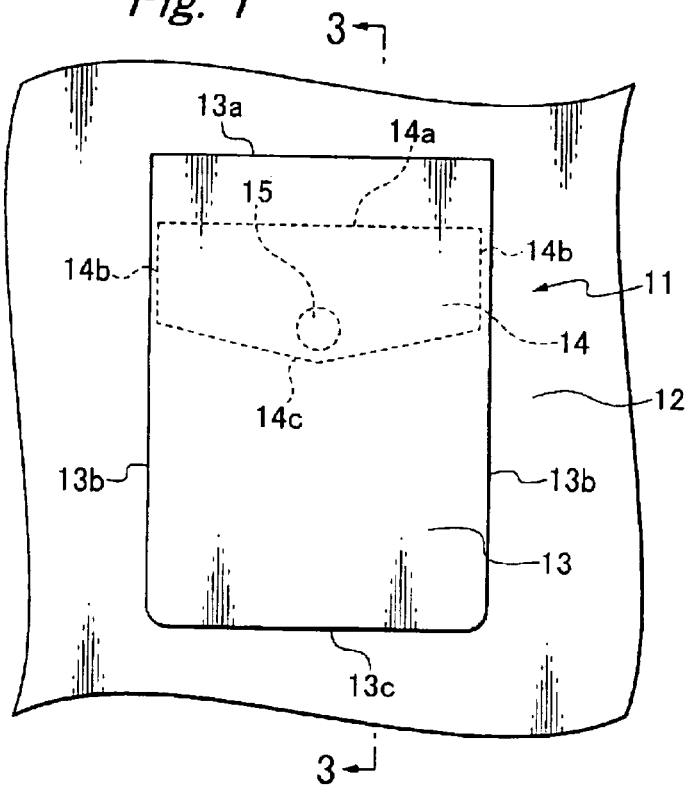
FIG. 1 is a front view of a pocket 11 according to a first embodiment of the present invention.
Figure 2:
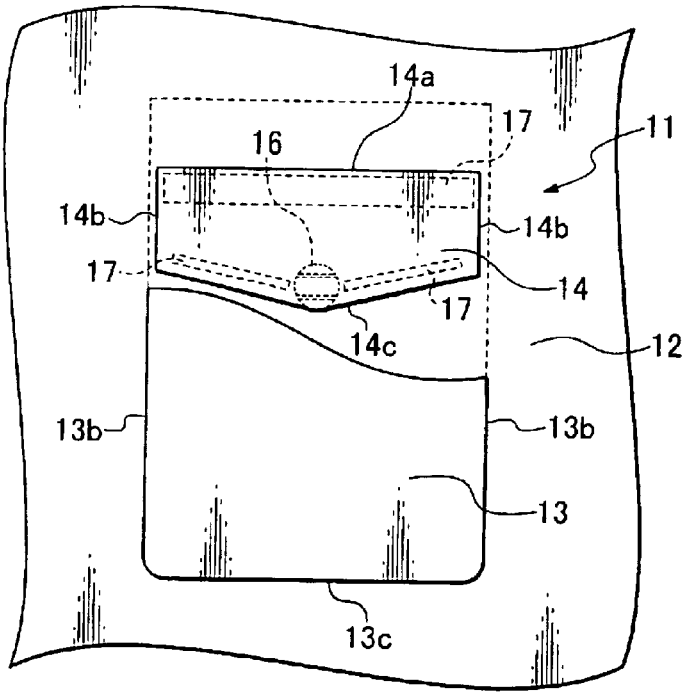
FIG. 2 is a similar front view of the pocket, but partly broken to show one example of a piece of seal cloth inside.
Figure 3:
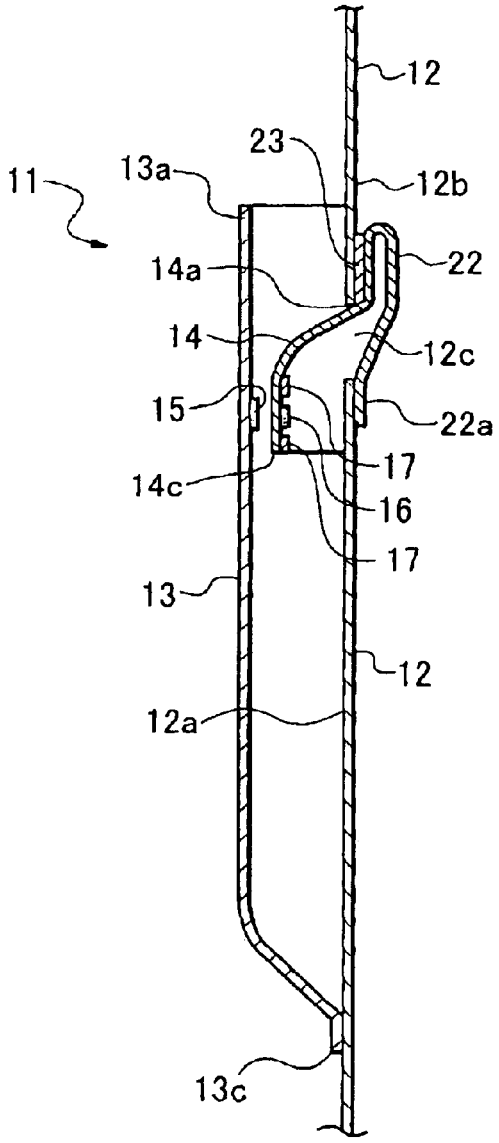
FIG. 3 is a longitudinal sectional view of the pocket taken along line 3—3 in FIG. 1.

Referring to FIGS. 1 to 3, a pocket 11 according to a first embodiment comprises a small flat cloth 13 sewn onto a front side 12*a* of a garment cloth 12 with its upper edge open, a piece of seal cloth 14 fixed to the front side 12*a* of the garment cloth 12 inside of and in the vicinity of the upper edge of the small flat cloth 13 for closing an opening 12*c* at the upper edge of the small flat cloth, and fastening structure 15 for detachably fastening the piece of seal cloth 14 to the small flat cloth 13.

A garment herein used, includes a dress shirt, utility shirt, polo shirt, shirtwaist, gown, cloak, foundation garment, suit, work dress, jumper, fatigue dress, pants and any other article of clothing, which can have at least one small flat cloth sewn onto its front and/or rear side as a pocket.

Material of the garment cloth 12 is nylon, polyester, vinylon or any other synthetic or chemical fiber, and cotton, linen, silk or any other natural fiber, and natural or artificial leather.

The opening 12*c* at the upper edge of the small flat cloth 13 is somewhat shorter than a lateral size of the pocket 11.

A predetermined size of flat cloth 13 is sewn along its opposite and lower edges 13*b* and 13*c* onto the garment cloth 12, leaving its upper edge 13*a* open, thus permitting small articles to be put into and removed from the pocket 11.

The small flat cloth 13 has a magnet member (fastening structure) 15 fixed thereto, which magnet member 15 can make a piece of metal 16 (later described) attached to the piece of seal cloth 14 come toward it, thus detachably fastening the piece of seal cloth 14 to the small flat cloth 13.

As seen from FIGS. 1 and 2, the piece of seal cloth 14 is somewhat shorter than a lateral length of the small flat cloth 13, and an upper edge 14*a* of the seal cloth 14 is close to the opening of the small flat cloth 13. The upper edge 14*a* and opposite edges 14*b* of the piece of seal cloth 14 are sewn onto the garment cloth, and lower edge 14*c* is left open.

As seen from FIGS. 1 and 3, the piece of seal cloth 14 is placed below the upper edge of the small flat cloth 13, so that it cannot be seen from the front side of the garment cloth.

As seen from FIG. 3, the piece of seal cloth 14 has a bag-like catch extension 22 formed therein. Catch extension 22 is partly sewn to a rear side 12*b* of the garment cloth 12 via a reinforcement piece of cloth 23, and a lower edge 22*a* of the catch extension 22 is sewn to the rear side of the garment cloth 12. Thus, the catch section 22 defines a bag-like space 12*c* opening at its lower side 14*c*.

The reinforcement cloth 23 makes the garment cloth 12 sufficiently hard so as to prevent any shrinking or bending, thus facilitating insertion and removal of an article 21 into and from the pocket 11.

Also, the reinforcement cloth 23 is sewn to the garment cloth 12 at a level lower than the upper edge 13*a* of the small flat cloth 13, thereby additionally facilitating insertion and removal of the article into and from the pocket 11.

As shown in FIGS. 2 and 3, the piece of seal cloth 14 has a piece of metal 16 fastened in confronting relation with the magnet member 15, so that the magnet member 15 may cause the piece of metal 16 to come towards it. The piece of metal 16 is preferably a sectored disk comprising three or more divisional sectors, thereby allowing a profile of the sectored disk to change and fit a convex part of the article 21, which abuts the sectored disk in the pocket 1.

In place of this magnet-and-metal piece, a hook loop fastener may be used as fastening structure. This material feels as soft as the material of the garment, and therefore, nobody can feel anything odd in the pocket 11.

As shown in FIGS. 2 and 3, the piece of seal cloth 14 is lined with strips of reinforcement metal or synthetic resin 17 to prevent the seal cloth 14 from bending or twisting, thus assuring that the seal cloth 14 provides a pocket-sealing effect.

Figure 6:
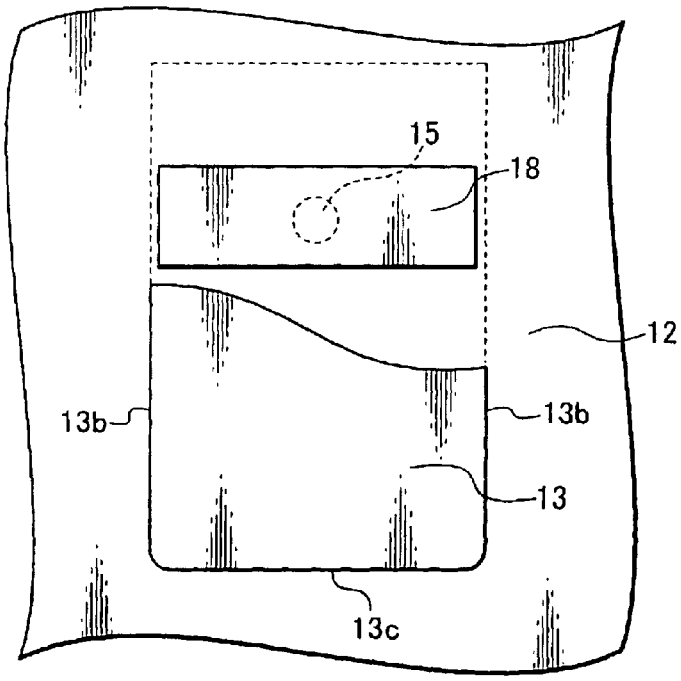
FIG. 6 is a front view of the pocket, partly broken to show another example of a piece of seal cloth inside.

Referring to FIG. 6, another example of piece of seal cloth 18 has no reinforcement 17, and the seal cloth 18 is made of a cloth material sufficiently thick to prevent any bending or twisting.

Figure 7:
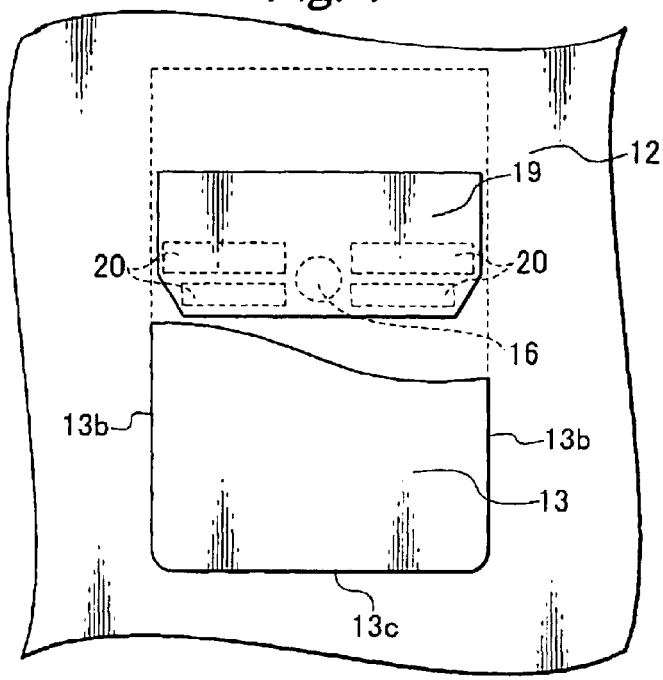
FIG. 7 is a front view of the pocket, partly broken to show still another example of a piece of seal cloth inside.

Referring to FIG. 7, still another example of piece of seal cloth 19 is relatively wide, and is lined with thin metal strips of reinforcement 20, which are arranged on both sides of metal piece 16. Reinforcement pieces 20 can be arranged different from those shown in FIGS. 2 and 7.

Figure 4:
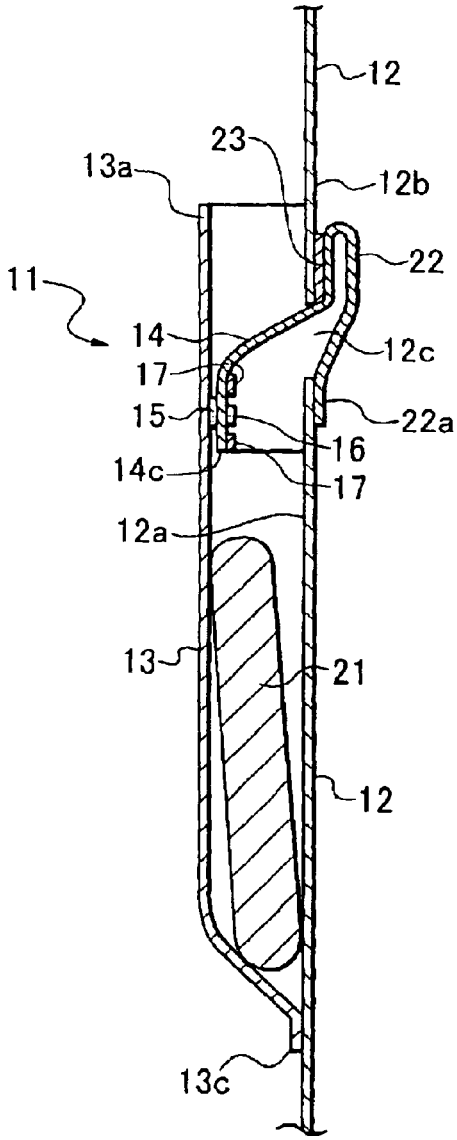
FIG. 4 is a similar longitudinal sectional view of the pocket, showing that a small article is put in the pocket.
Figure 5:
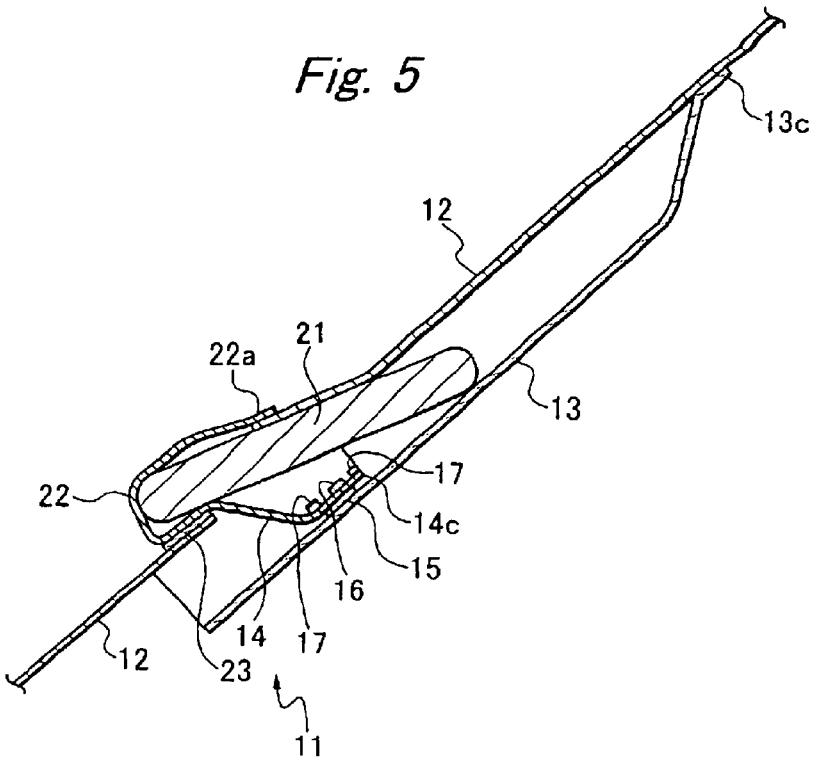
FIG. 5 is a similar longitudinal sectional view of the pocket illustrating how the article is caught by the bag-like catch extension when a person wearing the garment bends downwardly.

A manner in which a small article 21 such as a cellular phone or eyeglasses, is put and kept in the pocket 11 is described below. As seen from FIG. 4, the article 21 is put in the pocket 11 from the upper opening, and then, a light push is given to the small flat cloth 13 such that the magnet member 15 attracts the metal piece 16, thereby sealing the opening of the pocket 11 with the seal cloth 14.

When a person wearing the garment bends downwardly, the article 21 moves partly into the bag-like catch extension 22. The attractive force between the magnet member 15 and the metal piece 16 is strong enough to resist to a weight of the article 21, so that the seal cloth 14 cannot be separated from the flat cloth 13.

When the person wearing the garment moves quickly, the article 21 cannot spring up from the pocket 11 thanks to the bag-like catch extension 22.

The magnet member 15 can easily be separated from the metal piece 16 simply by inserting fingers from the outer edge 13*a* of the pocket 11 to remove the article 21 from inside the pocket.

Figure 8:
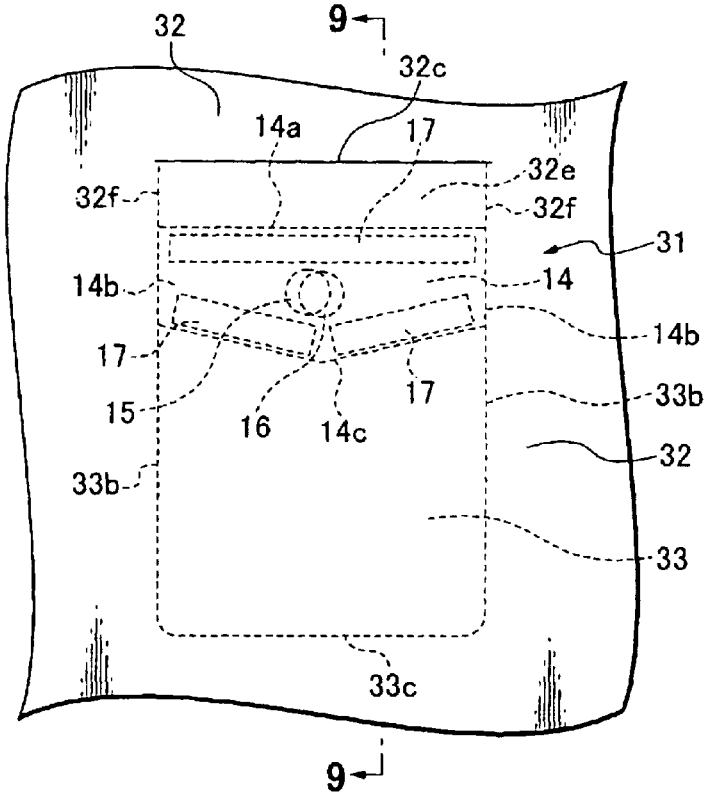
FIG. 8 is a front view of a pocket according to a second embodiment of the present invention.
Figure 9:
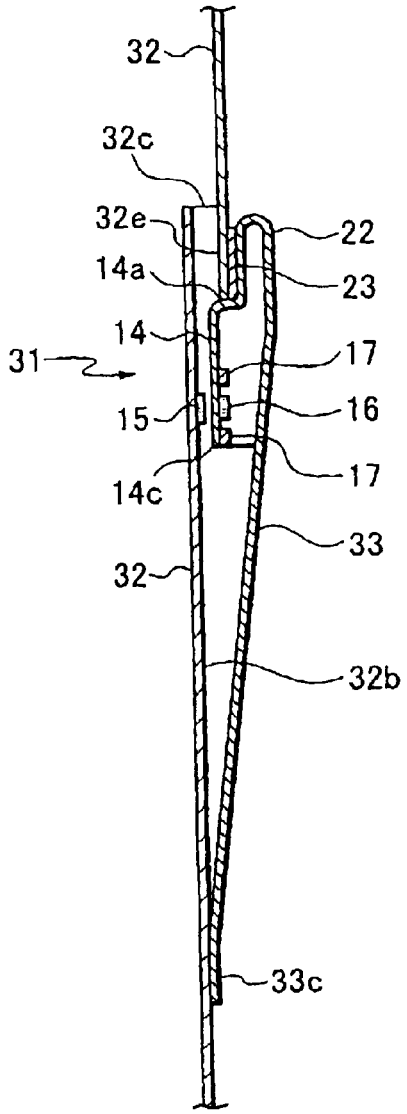
FIG. 9 is a longitudinal sectional view of the pocket taken along line 9—9 in FIG. 8.

FIGS. 8 and 9 show a pocket according to a second embodiment of the present invention. Same parts as in the first embodiment are indicated by same reference numbers as used in the relevant description and drawings, and detailed description thereof are omitted.

A small flat cloth 33 is sewn onto a rear side 32*b* of garment cloth 32, and a piece of seal cloth 14 is contiguous with a top edge of the small flat cloth 33 to be arranged between the small flat cloth 33 and the rear side 32*b* of the garment cloth 32.

Apparently, pocket 31 is shown as an inside pocket rather than that applied to a front side of the garment cloth. The pocket 31 has an upper lateral opening 32*c*, and a small article 21 can be put in the pocket 31 from the lateral opening 32*c*.

The garment cloth 32 has a short-distant patch 32*e* extending down beyond the lateral opening 32*c*. Opposite edges 32*f* and 32*f* of the patch 32*e* are sewn onto the garment cloth 32.

The garment cloth has a magnetic member 15 fastened to its rear side for attracting a metal piece 16 for sealing the lateral opening 32*c*, which metal piece 16 is fastened to seal cloth 14.

As seen from FIG. 8, the seal cloth 14 is somewhat shorter than a lateral length of the opening 32*c*. The seal cloth 14 is contiguous with the upper edge of the small flat cloth 33, and is sewn onto the patch 32*e*. Opposite longitudinal sides 14*b* of the seal cloth 14 are sewn onto the garment cloth 32. Thus, the seal cloth 14 opens at its bottom 14*c*.

As shown in FIGS. 8 and 9, the magnet member 15 is fastened to the garment cloth 32 in confronting relation with the metal piece 16 so that the magnet member 15 may cause the metal piece 16 to approach it for sealing the pocket 31.

As shown in these drawings, reinforcement pieces 17 of metal or synthetic resin are attached to the rear side of the seal cloth 14. The reinforcement pieces 17 have an effect of preventing the seal cloth 14 from being folded or twisted, thereby assuring that the pocket is sealed.

As seen from FIG. 9, the seal cloth 14 has a bag-like space 22 formed on its top side, and a bag-like section 22 is sewn onto the patch 32*e* of the garment 32 via a piece of reinforcement cloth 23.

The bag-like section 22 is contiguous with the small flat cloth 33. Opposite longitudinal sides 33*b* and bottom edge 33*c* of the small flat cloth 33 are sewn onto the garment cloth 32. Thus, the bag-like section 22 opens toward an open bottom 14*c* of the seal cloth 14.

Figure 10:
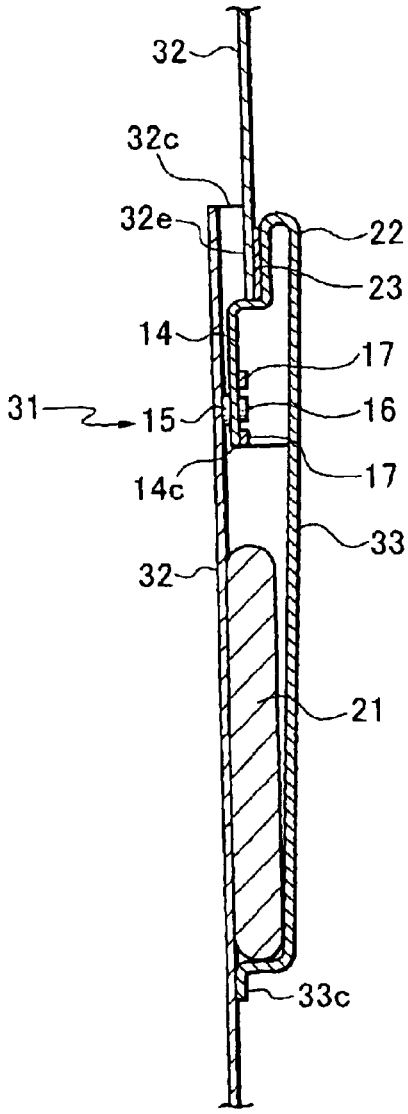
FIG. 10 is a similar longitudinal sectional view of the pocket, showing that a small article is put in the pocket.
Figure 11:
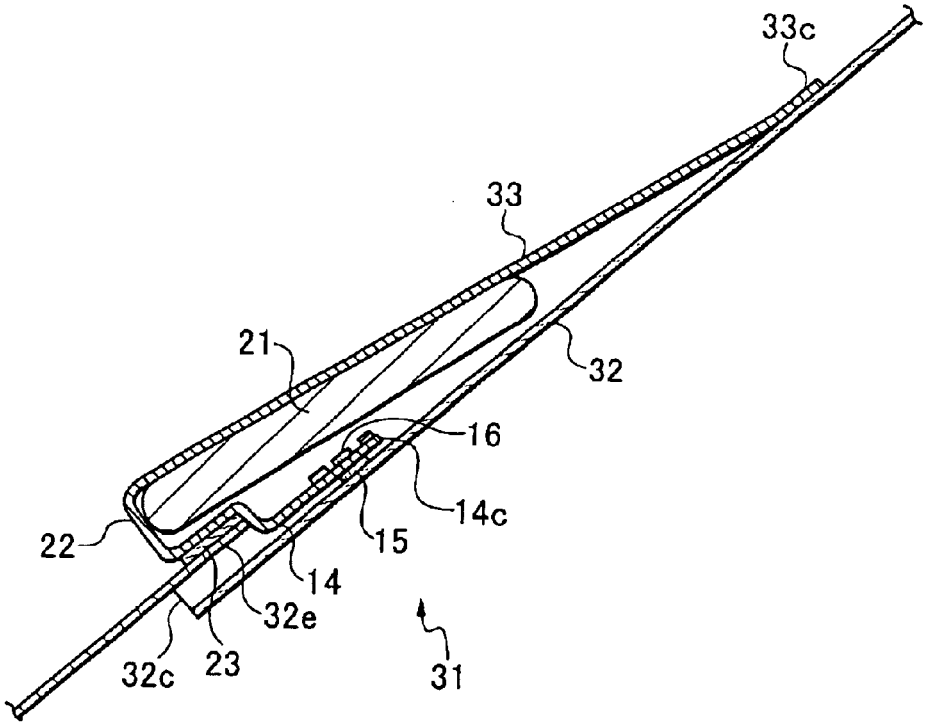
FIG. 11 is a similar longitudinal sectional view of the pocket, illustrating how the article is caught by a bag-like catch extension when a person wearing the garment bends downwardly.

A manner in which a small article 21 is put and kept in the pocket 31 is described below. As seen from FIG. 10, the small article 21 is inserted from the opening 32*c* to be put in the pocket 31, and then, a gentle push is given to the garment cloth 32 to allow the magnet member 15 to attract the metal piece 16. Thus, the opening 32*c* of the pocket 31 is sealed.

Even when a person wearing the garment bends down, the article 21 moves into the bag-like section 22. The sealing cloth 14 cannot be separated from the rear side of the garment cloth 32 by a weight of the article 21. When the person moves quickly, the article 21 cannot spring out from the pocket 31, and the article 21 is kept partly in the bag-like section 22.

Figure 12:
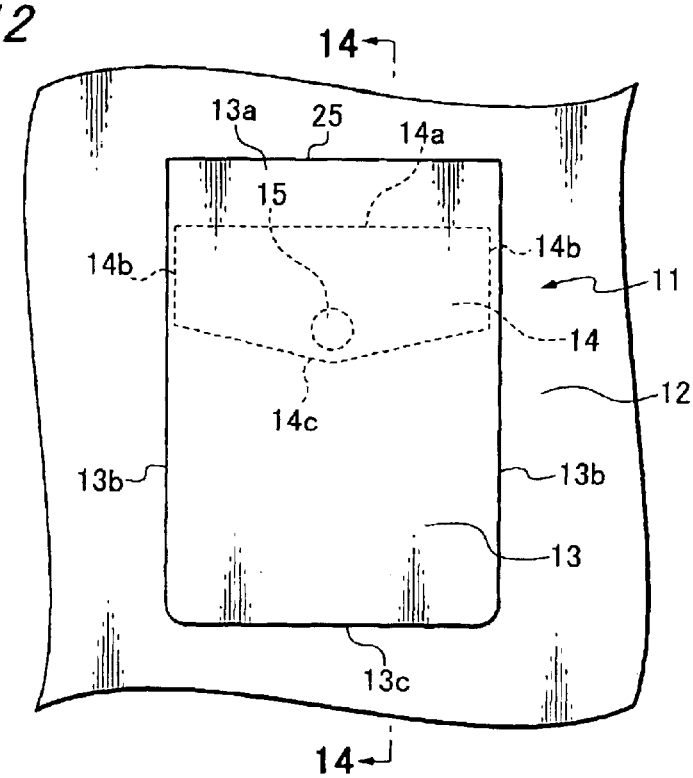
FIG. 12 is a front view of a pocket according to a third embodiment of the present invention.
Figure 13:
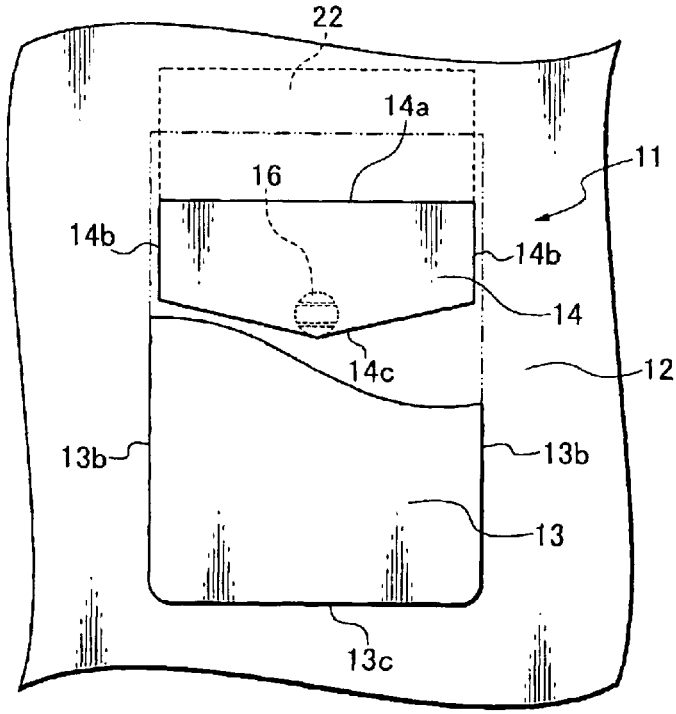
FIG. 13 is a front view of the pocket whose pouch cloth is partly cut and removed to show a seal cloth.
Figure 14:
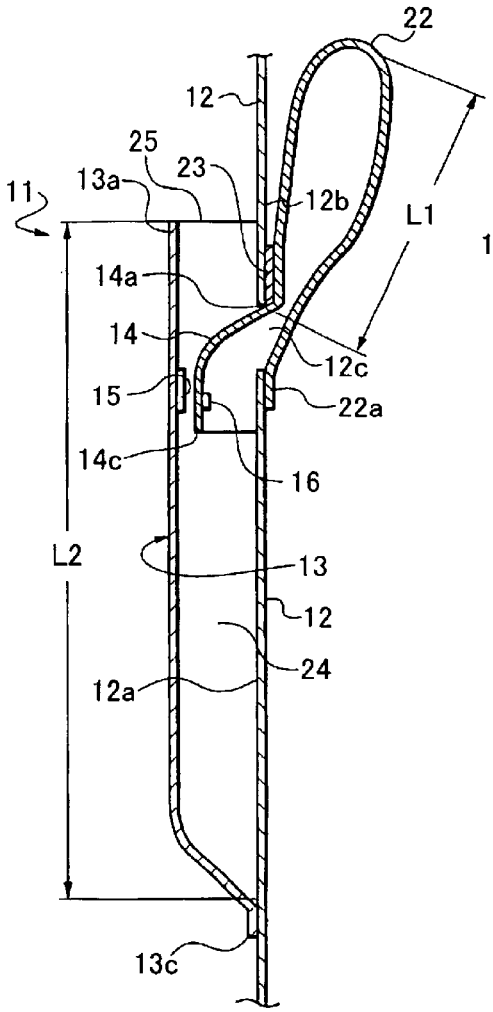
FIG. 14 is a longitudinal sectional view of the pocket taken along line 14—14 in FIG. 12.

FIGS. 12 to 16 show a pocket 11 according to a third embodiment of the present invention. Referring to FIGS. 12 to 14, the pocket 11 comprises a small, flat cloth or pouch cloth 13 sewn onto an outer side 12*a* of a garment cloth or material 12 to define an article-containing space 24 with top edge 13*a* open, and a bag-like catch extension 22 which extends from a part of the garment cloth lying behind the pouch cloth 13. The bag-like catch extension 22 has a piece of seal cloth 14 integrally connected to an end of the bag-like catch extension 22 so that the seal cloth 14 may be close to opening 25 of the pocket 11.

The pocket 11 can be sewn into any kind of garment such as a utility shirt, a polo shirt, a shirtwaist or blouse, a suit, a jacket, trousers, a skirt, a working dress or a jumper. The jacket or jumper can have pockets sewn to its outer and inner sides.

Garment materials include nylon, polyester, vinylon and any other synthetic or chemical fibers, cotton, linen, silk and any other natural fiber materials, and natural or synthetic leather, i.e. whatever materials from which the garment may be formed.

Referring to FIG. 14, a lateral slit 12*c* is made in the garment cloth 12, and the slit 12*c* is somewhat shorter than the opening 25 of the pocket 11.

The pouch cloth 13 is sewn onto the garment cloth 12 on opposite sides 13*b*,13*b* and a bottom side 13*c*, leaving the upper edge 13*a* open to define the opening 25, via which a small article or articles can be put into article-containing space 24.

The pouch cloth 13 has a magnet member 15 attached to its inner side, which magnet member 15 can apply an attractive force to a magnetic object attached to the seal cloth 14, as later described (fastening structure). The magnet member 15 preferably comprises a flexible magnet sheet, which causes a person wearing the garment cloth to feel little or no strange sensation.

Referring to FIGS. 12 and 13, the seal cloth 14 is somewhat shorter than the pouch cloth 13 in a lateral dimension. The seal cloth 14 is sewn on its upper side 14*a* onto the garment cloth 12 at an upper portion of the lateral slit 12*c*, while opposite sides 14*b*,14*b* and a bottom side 14*c* remain unsewn. The seal cloth 14 is preferably made of a softer material than the garment cloth and the pouch cloth, so that the person wearing the garment will fe el little or no strange sensation.

As seen from FIGS. 12 and 14, the upper edge 14*a* of the seal cloth 14 is at a lower level than the upper edge 13*a* of the pouch cloth 13, and therefore, the seal cloth 14 is hidden behind the pouch cloth, and cannot be seen from outside the pocket.

As seen from FIG. 14, the upper edge 14*a* of the seat cloth 14 is connected to a bag-like catch extension 22, which is sewn via an intervening reinforcement cloth 23 onto an inner side 12*b* of the upper portion of the lateral slit 12*c* formed in the garment cloth 12. A lower edge 22*a* of the bag-like catch extension 22 is sewn onto a lower edge of the lateral slit 12*c*.

Thus, a space in the bag-like extension 22 communicates with article-containing space 24 of the pocket 11 via the lateral slit 12*c*.

Figure 16:
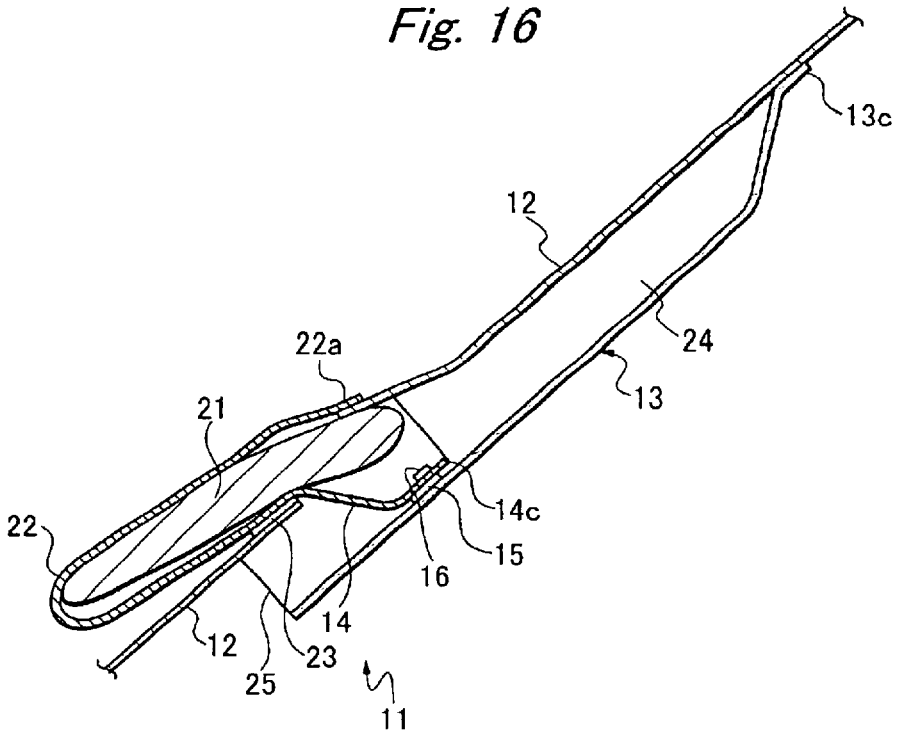
FIG. 16 is a similar longitudinal sectional view of the pocket when a person wearing the garment stoops down with the small article put in the pocket.

Dimension L1 of the bag-like catch extension 22 preferably is at least one third dimension L2 of the pocket 11. Referring to FIG. 16, when a person wearing the garment cloth bends his upper body downwardly, article 21 is displaced from the article-containing space 24 to the space in the bag-like extension 22 via the slit 12*c*, thereby keeping the article 21 held in the pocket 11.

The reinforcement cloth 23 effectively makes entrance on a rear side free of any wrinkle, keeping it sufficiently stiff to facilitate insertion of the small article 21 into the article-containing space 24.

The reinforcement cloth 23 is sewn onto the garment cloth 12 to be below the upper edge 13*a* of the pouch cloth 13, thus facilitating insertion of articles 21 into the article-containing space 24.

As seen from FIGS. 13 and 14, the magnetic object 16 is attached to the inner side of the seal cloth 14 in confronting relation with the magnet member 15, so that they may be magnetically attracted and stuck to each other, thereby sealing the pocket 11 with the seal cloth 14. The magnetic object 16 may be of pulverized magnetic material, flexible magnetic wires or short magnetic plates. The magnetic object 16 may comprise three or more sector divisions which can be combined into a circle. Advantageously, a circular combination of such sectors can be responsive to a salient article for changing its shape to conform to a salient portion of the article.

Fastening structure other than magnetic fastening structure 15, 16 may be used. For example, two pieces of pressure-sensitive tape, or hooks and loops may alternatively be used. Advantageously, this sort of tape is as soft as the garment or seal cloth, and therefore, presence of any foreign substance may not be perceived.

Figure 15:
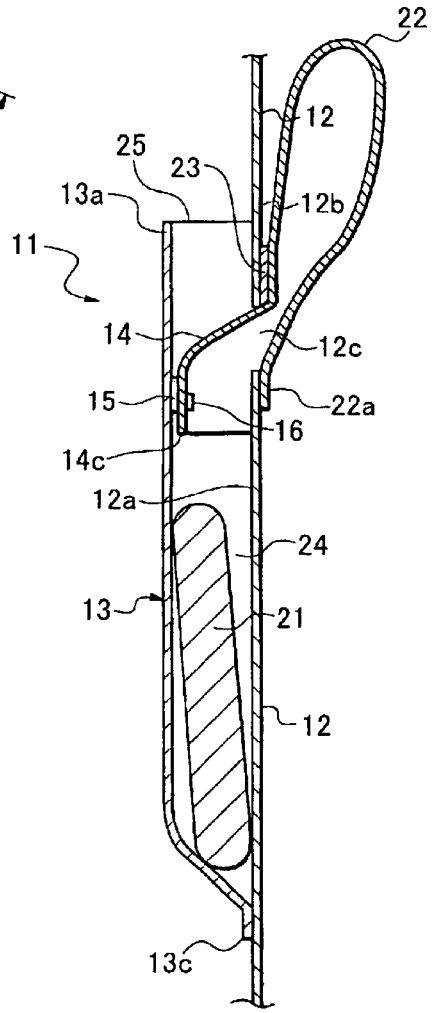
FIG. 15 is a similar longitudinal sectional view of the pocket, but showing that a small article is put into the pocket.

In use, when an article 21 is put into the pocket 11, the pouch cloth 13 is pushed lightly to allow the magnet member 15 to attract the magnetic object 16, whereby the pocket 11 is sealed with the seal cloth 14, as seen from FIG. 15.

Assuming that a person wearing the garment bends his upper body downwardly, the article 21 is displaced from the article-containing space 24 to the space in the bag-like catch extension 22, as seen from FIG. 16. Sealing obtained by magnetic members 15 and 16 cannot be broken by a weight of the article 21.

Even vigorous movement does not allow the article 21 to spring up from the pocket, via the presence of the seal cloth 14 and the bag-like catch extension 22.

Advantageously, a pair of eyeglasses, a cellular phone or any other fragile article can be put in such a scaling pocket at ease, because of no fear that these articles will come out of the pocket and fall on the ground.

When the article 21 is to be removed, a finger is inserted into the opening 25 to easily separate the magnet member 15 and the magnetic object 16 from each other, and then the article 21 can be removed as usual.

FIGS. 17 to 20 show a pocket according to a fourth embodiment of the present invention. In these drawings same portions as the pocket 11 according to the third embodiment are indicated by same numerals as used in FIGS. 12 to 16. Detailed descriptions including these in respect of from what materials they are made are omitted.

Pocket 31 comprises a small, flat cloth or pouch cloth 33 sewn onto a rear side 32*b* of garment cloth or material 32 to define an article-containing space 24 with top edge 32*c* open, and a bag-like catch extension 22 extending from the pouch cloth 33. The bag-like catch extension 22 has a piece of seal cloth 14 integrally connected to an end of the extension 22, lying behind the garment cloth 32.

The pocket 31 can be sewn into a suit, jumper and trousers and other clothes, not only on an exterior thereof but also on an interior thereof.

Figure 17:
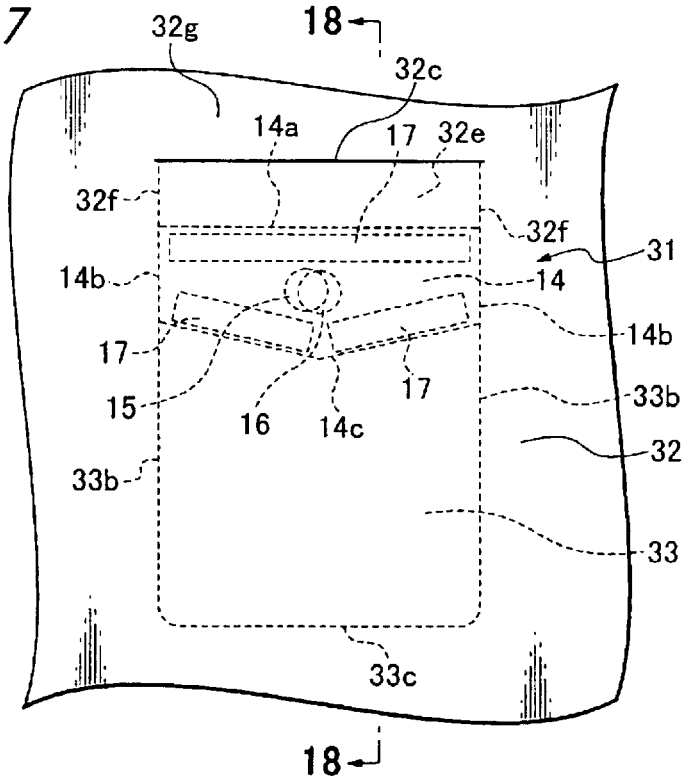
FIG. 17 is a front view of a pocket according to a fourth embodiment of the present invention.
Figure 18:
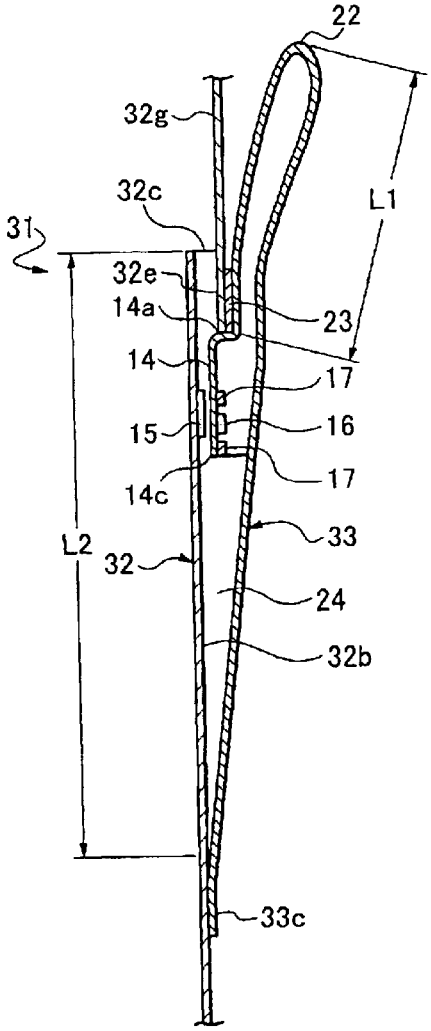
FIG. 18 is a longitudinal sectional view of the pocket taken along line 18—18 in FIG. 17.

As seen from FIGS. 17 and 18, a lateral opening 32*c* of predetermined length is made to allow small articles to be put into the article-containing space 24.

A lower extension 32*e* of upper part 32*g* of garment cloth 32 is behind a lower part of the garment cloth 32, and the lower extension 32*c* is sewn on opposite sides 32*f*,32*f* onto the garment cloth 32. Thus, the seal cloth 14 is hidden behind the garment cloth 32 and cannot be seen from outside the garment cloth.

A magnet member 15 is attached to an inside of the garment cloth 32. The magnet member 15 can apply an attractive force to a magnetic object 16 attached to the seal cloth 14, as later described. The magnet member 15 is preferably of a flexible magnet sheet, which causes a person wearing the garment to feel little or no strange sensation.

Referring to FIG. 17, the seal cloth 14 is somewhat shorter laterally than the opening 32*c*. The seal cloth 14 is sewn on its upper side 14*a* onto a lower end of the upper part 32*g* of the garment cloth 32, while opposite sides 14*b*,14*b* and a bottom side 14*c* remain unsewn. The seal cloth 14 preferably is made of a material softer than the garment cloth 32 or pouch cloth 33, so that the person wearing the garment will feel little or no strange sensation.

As seen from FIGS. 17 and 18, the magnetic object 16 is attached to the inner side of the seal cloth 14 in confronting relation with the magnet member 15, thus permitting the seal cloth 14 to be releasably stuck to the magnet member 15 (fastening structure). The magnetic object 16 may be of a pulverized magnetic object, flexible magnetic wires or short magnetic plates.

As shown in FIGS. 17 and 18, the seal cloth 14 is lined with reinforcement pieces 17, which are thin plates of synthetic resin or metal. The reinforcement pieces 17 effectively prevent the seal cloth 14 from twisting or bending, thereby assuring reliable sealing of the pocket 11.

As seen from FIG. 18, the upper edge 14*a* of the seal cloth 14 is connected to an end of the bag-like catch extension 22, which is sewn onto the lower extension 32*e* of the garment cloth via an intervening reinforcement cloth 23.

As described earlier, the bag-like catch extension 22 extends from the pouch cloth 33, which is sewn on the opposite sides 33*b*,33*b* and the bottom 33*c* onto the garment cloth 32. Thus, the space in the bag-like catch extension 22 communicates with the article-containing space 24.

Figure 20:
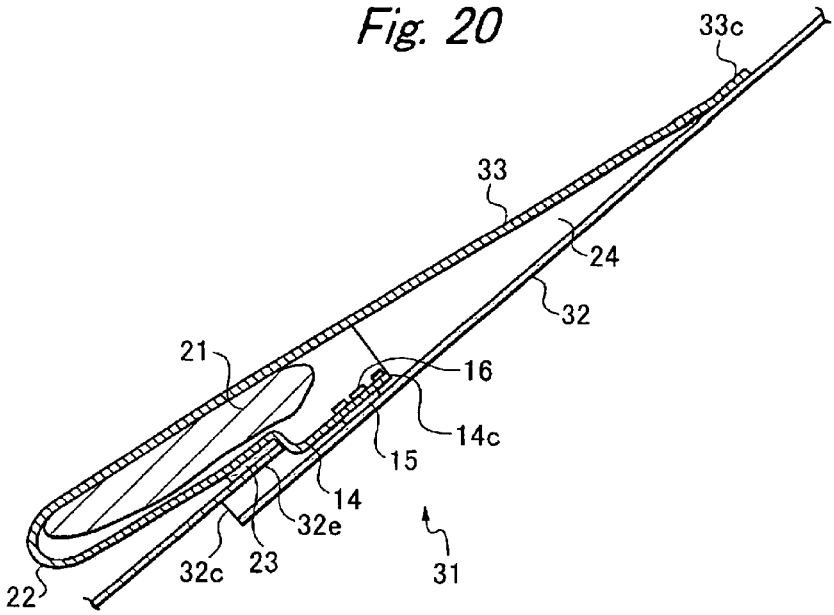
FIG. 20 is a similar longitudinal sectional view of the pocket when a person wearing the garment stoops down with the small article put in the pocket.

As seen from FIG. 18, dimension L1 of the bag-like catch extension 22 preferably is at least one third dimension L2 of the article-containing space 24. Referring to FIG. 20, a person wearing the garment stoops down to allow article 21 to be displaced from the article-containing space 24 to the space in the bag-like catch extension 22, and then the article 21 is positively held in the pocket 11.

Figure 19:
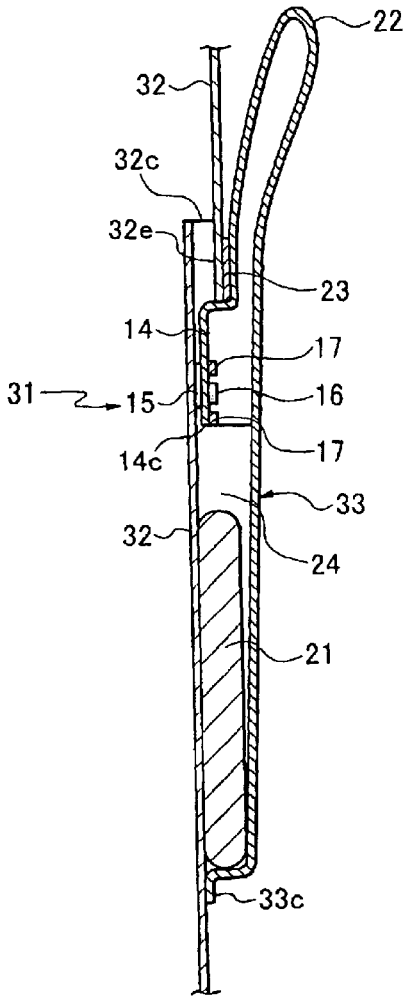
FIG. 19 is a similar longitudinal sectional view of the pocket, but showing that a small article is put in the pocket.

In use, after the article 21 is inserted from the opening 32*c* into the article-containing space 24, the pocket 31 is pushed lightly to cause the magnet member 15 to attract the magnetic object 16, thus sealing the pocket 31 with the seal cloth 14, as seen from FIG. 19.

Assuming that the person wearing the garment stoops down, the article 21 is displaced from the article-containing space 24 to the space in the bag-like catch extension 22, as shown in FIG. 20. Sealing resulting from attraction of members 15 and 16 cannot be broken by a weight of the article 21. Even vigorous movement does not allow the article 21 to spring up from the pocket, via presence of the seal cloth 14 and the bag-like catch extension 22.

Figure 21:
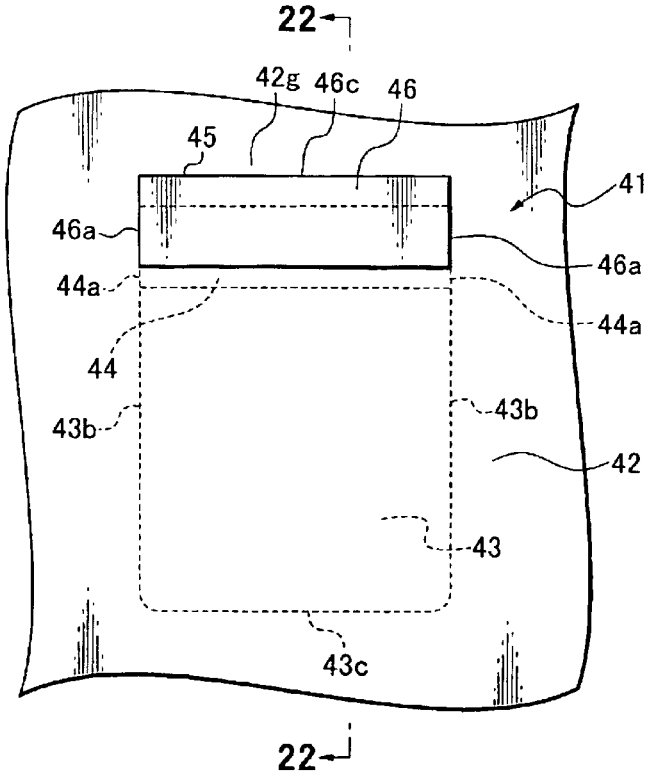
FIG. 21 is a front view of a pocket according to a fifth embodiment of the present invention.
Figure 22:
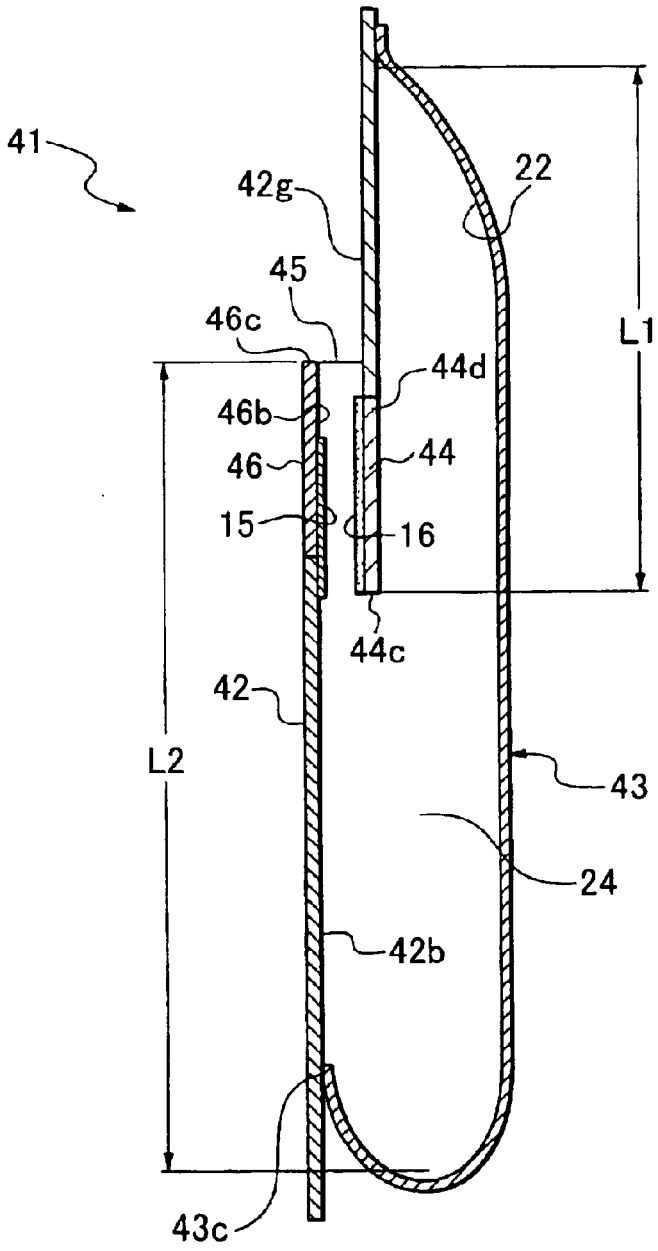
FIG. 22 is a longitudinal sectional view of the pocket taken along line 22—22 in FIG. 21.

FIGS. 21 and 22 show a pocket 41 according to a fifth embodiment of the present invention. In these drawings, same portions as in the pockets 11 and 31 according to the third and fourth embodiments are indicated by same reference numerals as used in FIGS. 12 to 16, and FIGS. 17 to 20, and detailed descriptions including those in respect of from what materials they are made are omitted.

The pocket 41 comprises a small, flat pouch cloth 43 sewn onto a rear side 42*b* of a garment cloth or material 42 to define an article-containing space 24 with a top edge 46*c* open, and a bag-like catch extension 22 from the pouch cloth 43 sewn onto an inner or rear side of an upper part 42*g* of the garment cloth 42. A piece of seal cloth 44 is fastened to a lower end of the upper part of garment cloth 42, thus lying below opening 45 of the pocket 41 for sealing the article-containing space 24.

Lateral opening 45 has a predetermined width to allow small articles to be put into the article-containing space 24.

The pocket 41 has an extra strip of cloth 46 integrally connected to a top of the pocket-defining section of the garment cloth 42. The extra strip of cloth 46 is somewhat harder than material of garment cloth 42, and is sewn on opposite sides 46*a*,46*a* onto the garment cloth 42.

A magnet member 15 is attached to an inner or rear side of the extra strip of cloth 46. The magnet member 15 can apply an attractive force to a magnetic object 16 attached to the seal cloth 44, as later described (fastening structure). The magnet member 15 is preferably of a flexible magnet sheet, which causes a person wearing the garment cloth to feet little or no strange sensation.

The seal cloth 44 is integrally connected to the upper part 42*g* of the garment cloth, and is as wide as the lateral opening 45. The seal cloth 44 is sewn on opposite sides 44*a*,44*a* onto the garment cloth 42, with bottom side 44*c* remaining unsewn. The seal cloth 44 is preferably made of a softer material than that of the garment cloth, so that the person wearing the garment will feel little or no odd sensation.

As seen from FIG. 22, an upper edge 44*d* of the seal cloth 44 is at a lower level than an upper edge 46*c* of the extra strip of cloth 46, and therefore, the seal cloth 44 is hidden behind the extra strip of cloth 46 and cannot be seen from outside the garment cloth.

The magnetic object 16 is attached to the seal cloth 14. The magnetic object 16 may be of pulverized magnetic metal, flexible magnetic wires or a short magnetic plate.

The pouch cloth 43 is sewn on opposite sides 43*b*,43*b* and bottom side 43*c* onto the garment cloth 42 so that the article-containing space 24 may communicate with a space in bag-like catch extension 22.

Dimension L1 of the bag-like catch extension 22 preferably is at least one third dimension L2 of the pocket 31. Even when a person wearing the garment stoops down, an article 21 is displaced from the article-containing space 24 to the space in the bag-like catch extension 22, thus keeping the article 21 held in the pocket 41.

What is claimed is:

1. A pocket comprising:

a first space for containing an article, said first space being on a first side of a portion of a garment and having an opening at one end of said first space; and a bag-like catch extension defining a second space for retaining the article, said second space being in communication with said first space; and structure for releasably closing said opening, wherein said second space is near said opening and on a second side of said portion of said garment, with said first side of said portion being opposite to said second side of said portion.

2. The pocket according to claim 1, wherein said bag-like catch extension comprises a seal cloth attached to said portion of said garment.

3. The pocket according to claim 2, wherein said seal cloth is attached to said portion of said garment by being sewn to said portion near said opening.

4. The pocket according to claim 3, wherein said structure for releasably closing said opening comprises first and second members that cooperate with one another to seal said opening, with said first member being on said seal cloth and said second member being on a piece that defines a front side of the pocket.

5. The pocket according to claim 4, wherein said bag-like catch extension is partially defined by a portion of said seal cloth that extends away from where said seal cloth is sewn to said portion of said garment and in a direction toward a level at which said opening is located.

6. The pocket according to claim 5, wherein said second space has a length that is at least one third a length of said first space.

7. The pocket according to claim 5, wherein said seal cloth is softer than said portion of said garment.

8. The pocket according to claim 5, wherein said first member comprises a magnetic object, and said second member comprises a magnet member.

9. The pocket according to claim 8, wherein said magnet member comprises a flexible magnet sheet.

10. The pocket according to claim 5, wherein said seal cloth is lined with a reinforcement piece.

11. The pocket according to claim 10, wherein said reinforcement piece comprises one of a thin synthetic resin plate or a thin metal plate.

12. The pocket according to claim 1, wherein said second space has a length that is at least one third a length of said first space.

13. The pocket according to claim 1, wherein said bag-like catch extension is of a material softer than said portion of said garment.

14. The pocket according to claim 1, wherein said structure for releasably closing said opening comprises first and second members that cooperate with one another to seal said opening, with said first member being a magnetic object on material defining said bag-like catch extension and said second member being a magnet member on a piece that defines a front side of the pocket.

15. The pocket according to claim 14, wherein said magnet member comprises a flexible magnet sheet.

16. The pocket according to claim 1, wherein material defining said bag-like extension is lined with a reinforcement piece.

17. The pocket according to claim 16, wherein said reinforcement piece comprises one of a thin synthetic resin plate or a thin metal plate.

18. The pocket according to claim 1, further comprising:

a seal cloth having (i) a first end attached to said portion of said garment, (ii) a first portion extending away from said first end, (iii) a folded portion extending from said first portion, and (iv) a second portion extending from said folded portion and terminating at a second end of said seal cloth, wherein said bag-like catch extension is defined by said folded portion.

19. The pocket according 18, wherein said structure for releasably closing said opening comprises first and second members that cooperate with one another to seal said opening, with said first member being on said second end of said seal cloth and said second member being on a piece that defines a front side of the pocket.

20. The pocket according to claim 19, wherein said first member comprises a magnetic object, and said second member comprises a magnet member.

* * * * *